US005462175A

United States Patent [19]

Bokor

[11] Patent Number: 5,462,175

[45] Date of Patent: Oct. 31, 1995

[54] SCREEN LINING

[75] Inventor: Anton Bokor, Stutensee, Germany

[73] Assignee: Western Wire Works, Inc., Portland, Oreg.

[21] Appl. No.: 67,477

[22] Filed: May 25, 1993

[30] Foreign Application Priority Data

Feb. 10, 1993 [DE] Germany ..... 43 03 892.1

[51] Int. Cl.[6] ..... B07B 1/49

[52] U.S. Cl. ..... 209/399; 209/314; 209/405

[58] Field of Search ..... 209/399, 403, 209/404, 405, 407, 408, 313, 314, 392, 319

[56] References Cited

U.S. PATENT DOCUMENTS

| | | | |
|---|---|---|---|
| 4,670,136 | 6/1987 | Schmidt et al. | 209/403 |
| 4,757,664 | 7/1988 | Freissle | 209/399 X |
| 4,909,929 | 3/1990 | Tabor | 209/405 X |
| 5,085,324 | 2/1992 | Dehlen | 209/399 |
| 5,213,217 | 5/1993 | Galton et al. | 209/399 |

FOREIGN PATENT DOCUMENTS

| | | | |
|---|---|---|---|
| 2574007 | 6/1986 | France | 209/399 |

*Primary Examiner*—D. Glenn Dayoan
*Assistant Examiner*—Tuan N. Nguyen
*Attorney, Agent, or Firm*—Marger, Johnson, McCollom & Stolowitz

[57] ABSTRACT

This invention concerns a screen lining for a screening machine whose screen frame has parallel supporting sections running in the direction of conveyance of the screened material, with plate-shaped screen elements made of plastic that form the screen surface and have locking devices at least on the sides facing the supporting sections with which they can be locked on strips having corresponding locking devices, which strips in turn have locking devices on the lower side for detachable connection to the supporting sections.

25 Claims, 5 Drawing Sheets

SCREEN LINING

BACKGROUND OF THE INVENTION

This invention concerns a screen lining for a screening machine whose screen frame has parallel supporting sections running in the direction of conveyance of the screened material, with plate-shaped screen elements made of plastic that form the screen surface and have locking devices at least on the sides facing the supporting sections with which they can be locked on strips having corresponding locking devices, which strips in turn have locking devices on the lower side for detachable connection to the supporting sections.

Screen linings of the aforementioned type are used for classifying granular materials such as construction materials, ores and so forth. The replaceable screen elements made of plastic such as castable polyurethane used for this purpose are characterized by good wear resistance to hard materials for screening that cause wear and on the other hand are characterized by their good elasticity which makes it possible to join the screen elements to the supporting sections and/or each other by means of relatively simple locking devices and with the additional advantage that they can be installed manually by means of a simple hammer without any other mounting devices and can also be lifted up and replaced manually by means of simple lever tools.

The known screen linings differ essentially only in the method of assembly and the structural devices needed for this purpose. For example, the screen elements are designed so they are flat on the facing ends and are provided with bolts that project downward and have a semicircular cross section (German Patent 2,437,809), whereby the semicircular bolts of neighboring screen elements complete each other to form a complete bolt and are engaged in suitably shaped holes on the supporting section of the screen frame. The bolts also form locking devices through an appropriate design on their periphery by means of which they engage in the holes on the supporting section to lock them. In assembly, the screen elements are positioned in such a way that the partial bolts which supplement each other to form a complete locking bolt can be driven from the top into the holes in the supporting section.

In another known embodiment (British Patent 1,228,454) the screen elements have holes into which pushbutton-like bolts are driven as locking devices so their top side rests on the screen element and they engage in appropriate recesses in the supporting section with a thickened end at the other end. With a similar system, cup-shaped recesses are provided on the facing ends of the screen elements and supplement each other with neighboring screen elements to form a type of borehole and they continue on the lower side in appropriate semicircular sleeves which have a back cut on the outside as a locking device. By driving a bolt of a matching shape into the cupshaped recesses that supplement each other to form a borehole, the projecting semicircular sleeves are forced outward so they reach behind the open edge of the recess in the day supporting section. At the same time the bolt with a thickened end engages behind the free end of the sleeves in the manner of a lock. The bolt with its head sits in a type of blind hole and thus presses the neighboring screen elements onto the supporting section (German Patent 2,632,511) .

In addition, screen linings are also known (German Utility Patent 7,838,335), whereby the supporting section is a U-shaped section that is open at the top and its legs are spread at the free edges to form a rib-shaped bulge which thus forms back cuts on the inside and outside. The screen elements which are blunted with their flat end faces have ribs with grooves whose cross section corresponds to the cross section of the legs of the U section on the lower side so that neighboring screen elements can each be driven separately onto a leg of the U section and engage it from above.

Finally, it is also known (World Patent WO 90/05594) that mounting bolts made of plastic can be inserted into recesses in the supporting section, where these bolts are designed as spreading bolts on the end that engages in the recess and also have peripheral projections at some distance above the supporting belt, for example, a peripheral bead. The screen elements are provided with cup-shaped recesses on the facing ends, where these recesses in turn have indentations that correspond to the bead and supplement each other to form a closed hole-like contour on neighboring screen elements. The screen elements are driven with their recesses from above over the mounting bolts until the bead catches in the indentation and the screen element rests on the supporting section.

Furthermore, it is also known that with flat screen surfaces (German Utility Patent 9,109,466) cupshaped indentations that supplement each other to form a hole at the abutment of the screen elements can be provided on the facing sides of the screen elements. The cupshaped indentations are provided with a back cut in the form of a peripheral groove. A strip which has locking devices on its underneath side for locking onto the supporting section and has locking bolts on the top side arranged at the same distance is driven onto the screen elements and serves to provide the attachment to the supporting section. This design has the advantage that similar screen elements can be connected to any supporting sections by means of the strip which can have any desired locking devices on its lower side.

All known screen linings—only a few designs of which have been illustrated above—have their own supporting sections which have special recesses on the top side, while the screen elements in turn have corresponding locking devices. As a result these screen linings are not compatible—in other words, screen elements of one manufacturer cannot be mounted on an existing infrastructure with certain supporting sections from another manufacturer. Another important disadvantage of these screen linings is that a stepshaped arrangement of screen elements in the direction of conveyance, which is especially desirable when working with wet materials for screening that have a tendency to cake, cannot be-produced. Stair-step screen linings where the individual screen elements are inclined with an increasing slope in the direction of conveyance therefore require special screen elements which in turn cannot be used with flat screen surfaces. Thus it is known (World Patent WO 89/08509) that the screen element can be provided with ribs that project downward on the opposite ends in the direction of conveyance, in which case the rib that is toward the front in the direction of conveyance sits loosely on the flat infrastructure of the screen frame, and the rear rib in the direction of conveyance is locked onto a supporting section, so the individual screen element on this end rests at a higher level than on the front end in the direction of conveyance, which thus gives it its slope. The rear end in the direction of conveyance projects over the supporting section in the direction of conveyance and also reaches over the front end of the next screen element, forming a type of stair-step effect. These screen elements with different profiled ribs on opposite ends and with a specially shaped profile of the rib to be locked onto the supporting section consequently have an asymmetrical design and can be mounted only on special infrastructures. Furthermore, no flat screen surface can be produced from these screen elements.

SUMMARY OF THE INVENTION

Starting from the screen lining: described initially, which permits only a flat screen surface design when used as intended, this invention is based on the problem of creating a design whereby the screen elements are inclined in order to form a flat screen surface as well as a stair-step screen surface and can be used in combination with any supporting sections.

This problem is solved according to this invention by the fact that in order to form a screen lining with screen elements inclined with an increasing slope in the direction of conveyance and screen elements connected together in a stair-step design, the strips are designed with a wedge angle corresponding to the angle of slope of the screen elements in the direction of conveyance, and the locking devices are arranged on the strips for connecting the screen elements at the same wedge angle.

With the screen lining design according to this invention, the angle of slope necessary for a stair-step screen surface is implemented in a separate part, namely the wedge-shaped strip, while no adjustment measures need to be performed on the screen elements. Thus all traditional screen elements for flat screen surfaces can also be used to produce stair-step screen surfaces. Only the locking devices on the wedge-shaped strip need to be adjusted for connecting the screen elements to the locking devices, just as the locking devices on the lower side of the wedge-shaped strip are adjusted to the locking options which are defined by the supporting sections. This invention therefore also provides an opportunity for the first time to equip the screen surface of an individual screening machine with screen elements in a stair-step pattern in certain areas such as the feed area but otherwise have a flat arrangement, and it also makes it possible to replace individual screen elements in both areas or to switch elements from one area to another. In addition, any desired angle of slope can be produced through a corresponding wedge angle on the strip and this will be accomplished in an especially inexpensive manner because the strip requires a disproportionately smaller expense in terms of tools and materials in comparison with the screen elements. Finally, the design according to this invention can be implemented with any screening machine which has supporting sections running in the direction of conveyance regardless of whether the supporting sections are arranged so that they are aligned or offset.

Furthermore, the strip may have a length that corresponds to the extent of the screen element in the direction of conveyance but a preferred design is one whereby the strip is somewhat shorter than the extent of the screen element in the direction of conveyance. In this design, the strips that work together with the supporting section are directly connected to each other in the direction of conveyance, so the somewhat longer screen elements overlap each other in the area where the strips abut, so this abutment is largely kept free of screened material, which thus cannot be shaken into the gap between the strips.

The locking devices on the strip may be designed as a section that extends over the entire length of the strip or may be designed in the form of bolts and arranged at predetermined distances. In the former case, this yields a locking connection over the entire length, whereas in the second case this yields a point locking connection.

It is also possible to design the locking devices on the lower side of the strip and the locking devices for connecting the screen elements so they are different, i.e., like sections or like bolts. This yields the possibility of providing linear or spot connections between the strip and the supporting section and/or between the strip and the screen element in accordance with the respective requirements of the locking connection. Furthermore, this also makes it possible to use screen elements in combination with supporting sections with which they cannot normally be combined since the strip has the locking devices suitable for the supporting section on its lower side and also has the locking devices necessary for the given screen element.

In another advantageous design, the strip has the locking devices for connecting neighboring screen elements on its top side and has supporting surfaces for the screen elements on both sides of the locking devices, so the screen elements are adequately supported.

This invention also concerns a screen lining whereby the supporting sections do not run parallel but instead run across the direction of conveyance but the screen lining otherwise has the same design. With this screen lining, which permits only the design of a flat screen surface when used as intended, the problem defined above is solved according to this invention by the fact that in order to form a screen lining with screen elements that have an increasing slope in the direction of conveyance and are joined together in a stair-step manner, the locking devices on each strip are arranged at different heights with respect to the supporting section in order for the screen elements to be connected on both sides, in which case the difference in height is adjusted to the desirable angle of slope of the screen element between two supporting sections.

Due to the design of the strip according to this invention with the locking devices arranged at different levels, it is possible to use flat screen elements by having the screen element engage with the lower locking devices in the area of one supporting section or the strip locked there, while the screen element is locked on its opposing side with the locking device at a higher level on the strip of the next supporting section, so a flat screen element is arranged with an increasing slope between the supporting sections. The screen element which then follows in the direction of conveyance is in turn locked to the lower locking devices of the same strip so a stair-step effect is formed by the strip. The screen elements can be mounted and replaced independently of each other at any location in the screen surface. Furthermore, flat screen areas or those with an increasing slope and a stair-step arrangement of screen elements can be produced using the same screen elements. Likewise, the two different arrangements can be combined on a single screen area— for example, a stair-step arrangement in the feed area but a flat arrangement in the discharge area when processing materials that tend to cake in screening. Furthermore, the locking devices for connecting the screen elements may be designed in any desired manner and especially can be adapted to the locking devices of the screen elements commonly available on the market, so all these screen elements can be arranged with appropriately designed locking devices with an increasing slope and a stair-step arrangement in combination with the strip and appropriately designed locking devices.

Preferably the strip is designed as a parallelepiped and has the locking devices for the screen elements on its opposing longitudinal sides and the locking devices for the supporting section on its underneath side.

The traditional screen linings differ in the type of supporting sections of the screen frame. For example, supporting sections having a continuous longitudinal slit on the top side are known in that, for example, the free longitudinal edges of the legs of a U section are indented inward. In such a case this invention proposes that the locking devices on the underneath side of the strip be designed as a locking section that runs the length of the strip and can be engaged with the longitudinal slit.

However, if the supporting sections have recesses arranged at predetermined intervals on the top side as is the case, for example, with upright angle sections with boreholes in the upper horizontal leg, the locking devices on the underneath side of the strip according to this invention are designed as locking bolts which are arranged at predetermined intervals in accordance with the recesses in the supporting sections and can be made to engage with the recesses.

However, if the supporting sections have a rib on the top side, then this invention provides for the strip to have a groove that matches the rib on its underneath side.

With a screen lining for a screening machine whose screen frame has supporting sections that run in the direction of conveyance of the screen material with plate-shaped screen elements that are plastic to form the screen surface which are detachably placed on the supporting sections and have locking devices on at least two opposite sides by means of which they can be locked together and/or to the supporting sections, wedge-shaped strips with a wedge angle that corresponds to the angle of slope of the screen elements are provided to form a screen lining with screen elements having an increasing slope in the direction of conveyance and screen elements connected together in a stair-step manner and these wedge-shaped strips have locking devices on their underneath side that work together with the supporting sections and also have locking devices for connecting the screen elements.

DETAILED DESCRIPTION OF THE PREFERRED EMBODIMENT

Figure 1A:
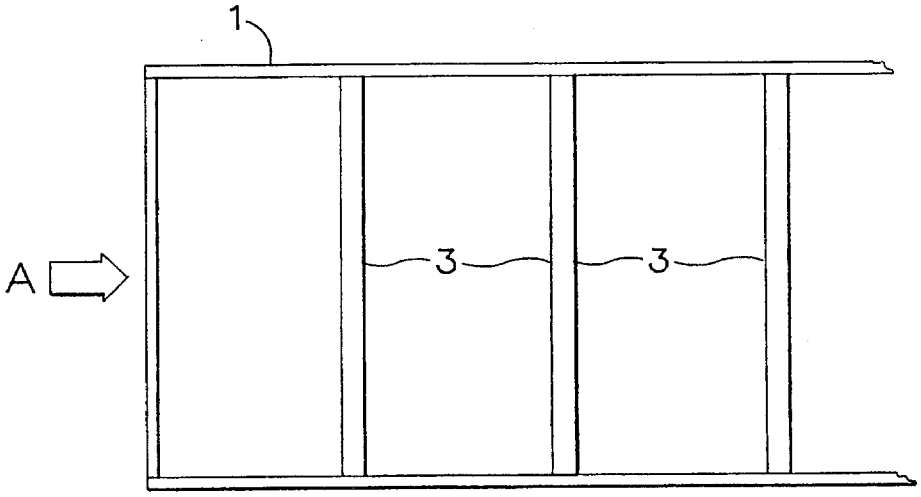
FIG. 1*a* shows a schematic top view of a screen surface of a screening machine in which the supporting sections 3 are positioned across the direction of conveyance A.
Figure 1B:
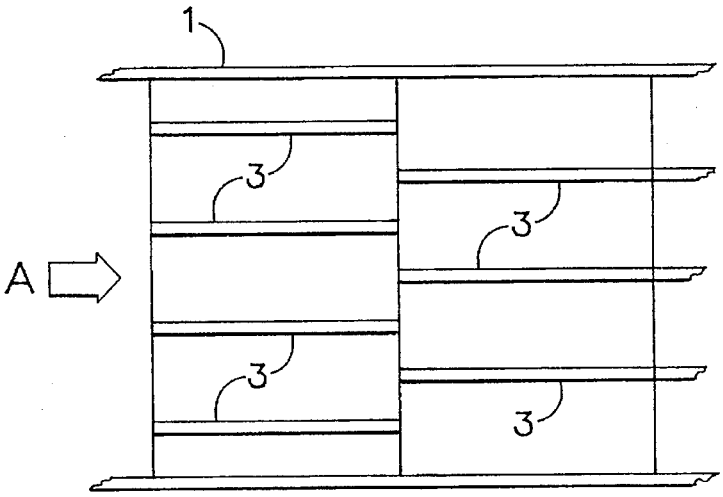
FIG. 1*b* shows a schematic top view of a portion of a screen surface of a screening machine in which the supporting sections 3 are positioned in the direction of conveyance A but are not aligned in the direction of conveyance A.
Figure 1C:
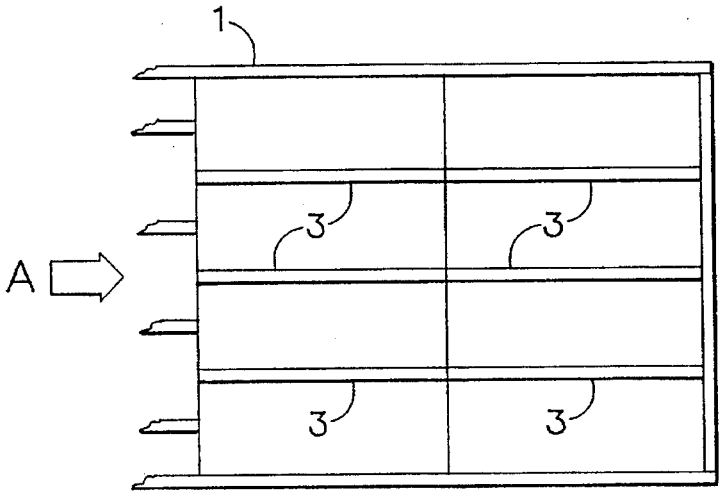
FIG. 1*c* shows a schematic top view of a portion of a screen surface of a screening machine in which the supporting sections 3 are positioned in the direction of conveyance A and are aligned in the directions of conveyance A.

Screen frame 1 of the screening machine which is not shown in detail here has supporting sections 3 that run in the direction of conveyance A and are optionally connected by crossbars to form grid-like fields. The supporting sections may be offset across the direction of conveyance A, as shown in of FIG. 1*a*, or may be arranged so they are aligned in succession, in the direction of conveyance A, as shown in of FIG. 1*b* and 1*c*. More specifically in FIGS. 1*b* and 1*c*, a portion of the screen surface of the screening machine is positioned in the direction of conveyance A, the screening surfaces of FIG. 1*b* being non-aligned, and the screening surfaces of FIG. 1*c* being aligned in the direction of conveyance A. The supporting sections 3 are designed at the top in such a way that they can hold the screen elements in a lock arrangement which is not shown in FIG. 1. As a rule one screen element will bridge the distance between two neighboring supporting sections 3.

Screen elements 2 made of rubber or a rubber elastic plastic such as polyurethane produced by casting have ribs 5, 6 that extend downward on their outer edges (FIGS. 2 to 4) and form a type of rectangular frame between which the actual screen surface with screen passages 7 is formed.

Figure 2:
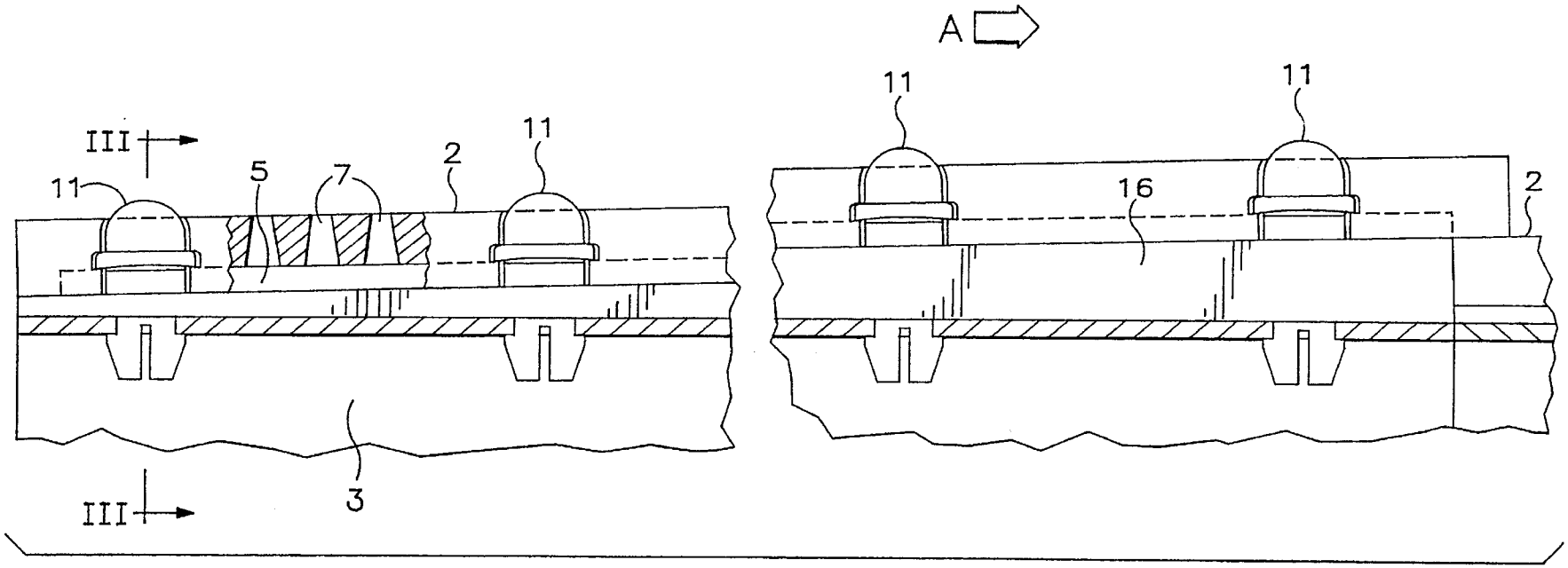
FIG. 2 shows a partially fragmentary side view of a screen lining in which the supporting sections are positioned across the direction of conveyance as depicted in FIGS. 1*b* or 1*c*.

As FIG. 2 shows, screen elements 2 are arranged with an increasing slope in the direction of conveyance A and form a stair-step effect at the transition from one screen field to the other. For this purpose, a wedge-shaped strip 16, which is arranged between screen elements 2 and supporting sections 3 is provided. The wedge angle of strip 16 corresponds to the desired angle of slope of the screen elements 2. The wedge-shaped strip 16 has locking devices on its underneath side by means of which it will be locked onto the supporting sections 3 and furthermore has locking devices on its top side for locking the screen elements 2 together. The locking devices on the underneath side of wedge-shaped strip 16 are designed in such a way that they can be locked to the conventional supporting sections while the locking devices on the top side or on the side faces of the wedge-shaped strip 16 are designed in such a way that they can be locked to the conventional screen elements 2 support sections 3 are arranged in position across the direction of conveyance A.

Figure 3:
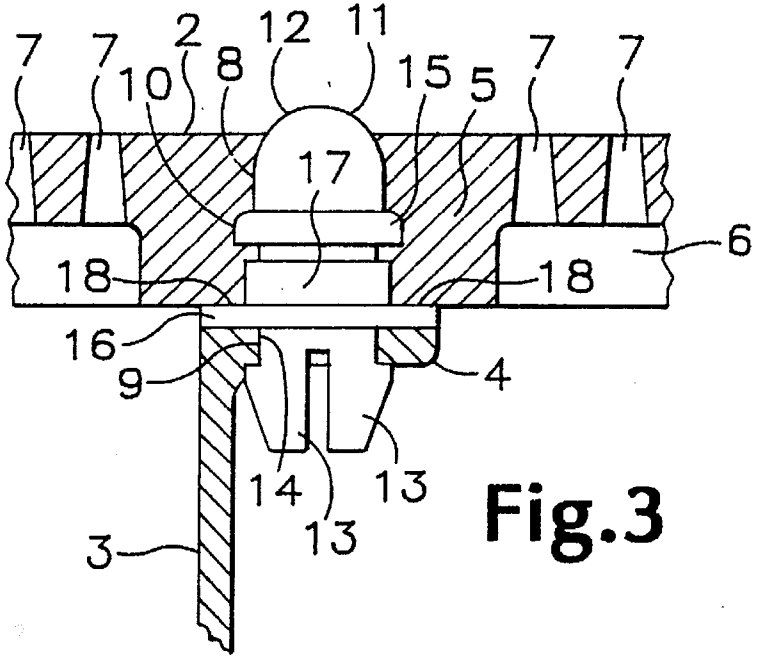
FIG. 3 shows a sectional view taken along line III—III of FIG. 2.

With the embodiments illustrated in FIGS. 2 and 3, the supporting section is designed as an angle profile and has a top supporting belt 4 with holes 9 arranged at predetermined intervals. Wedge-shaped strip 16 has spreading pins 13 arranged so the equidistant as locking devices and are connected by ring-shaped groove 14 to the underneath side of strip 16. Strip 16 is driven from above onto the supporting section 3 and spreading pins 13 lock under the supporting belt 4 when groove 14 sits in hole 9 of supporting belt 4.

Figure 4:
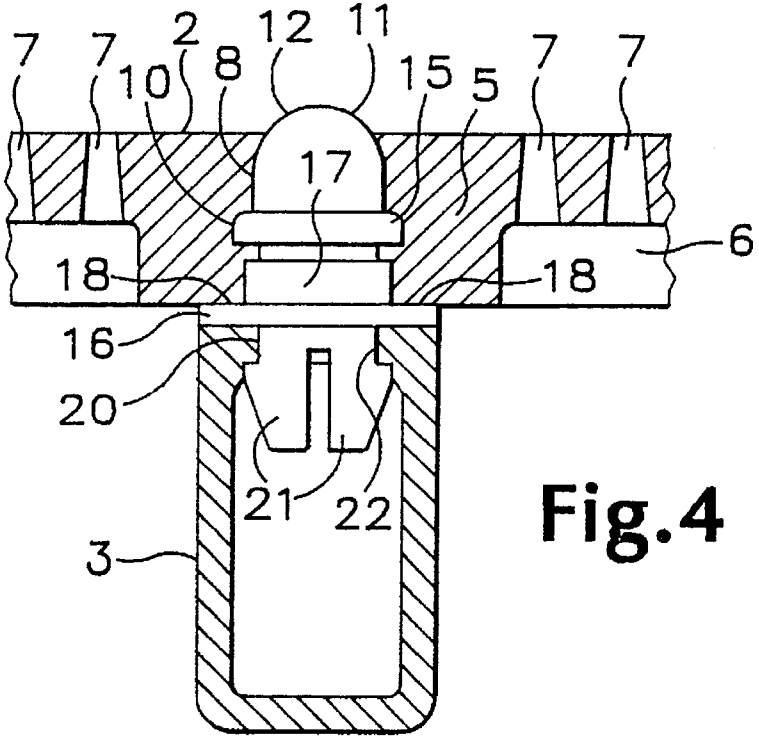
FIG. 4 shows sectional view of a different embodiment similar to that shown in FIG. 3.

In the practical example according to FIG. 4, the supporting section 3 is designed a U-shaped section whose legs are indented to form a slot 20. In this case the wedge-shaped strip 16 has a rib-shaped section with two flexible ribs 21 arranged with a distance between them and in turn attached by a constriction to the underneath side of strip 16 so that when strip 16 is driven onto supporting section 3, the ribs 21 catch toward the outside underneath slot 20 when constriction 22 engages in slot 20.

In the embodiment shown here, strip 16 has locking devices on its top side in the form of bolts 11 that are arranged at predetermined intervals and are each provided with a roundhead 12. The bolts also have a peripheral bead-shaped elevation 15 as the actual locking device and they are connected beneath bead-shaped elevation 15 to strip 16 by means of a cylindrical section 17. Screen elements 2 have semicircular cups 8 on opposite edges in the area of ribs 5. Cups 8 supplement each other onto side-by-side screen elements 2 to form a hole whose diameter corresponds to the diameter of bolts 11. Furthermore, the semicircular cups 8 have ring-shaped grooves 10 at some distance from the top side of the screen element. These ring-shaped grooves in turn fit the bead-shaped elevation 15 on bolts 11 in terms of depth and dimension. Finally, strip 16 has supports 18 that project over bolts 11 on both sides for the ribs 5 of the screen elements.

Assembly involves first driving locking devices 13 and 21 on the underneath side of the wedge-shaped strip 16 into the respective recesses 9 and 20 on the supporting sections 3 (see FIGS. 3 and 4) until strip 16 rests with its underneath side against the top side of the supporting section. Then a screen element 2 is inserted between neighboring supporting sections 3 and it is driven with its semicircular cups onto bolts 11 until ribs 5 rest with their underneath side on the support 18 of strip 16. In this way one screen field after the other can be fitted with screen elements. They are replaced by means of simple crowbars which are placed either beneath strip 16 or between this strip and the screen element 2 so the screen element can be lifted out.

The wedge-shaped strips 16 may be somewhat shorter than the screen elements in the direction of conveyance A so the screen elements overlap each other in the stair-step manner in the transition from one screen field to the next as illustrated in FIG. 2. Since the screen element 2 is designed with the same height over its entire length, it can also easily be inserted in a flat screen in combination with appropriate locking devices.

The locking devices may be designed in any desired manner and especially may be adapted to the locking sections of conventional screen elements so that with any known supporting sections and any screen elements optionally stair-step or horizontal flat screen surfaces can be produced by means of the wedge-shaped strips 16. In particular it is also possible to provide bolt-like or sectional locking devices on the underneath side and optionally sectional or bolt-like locking devices on the top side of the wedge-shaped strip 16.

Figure 5:
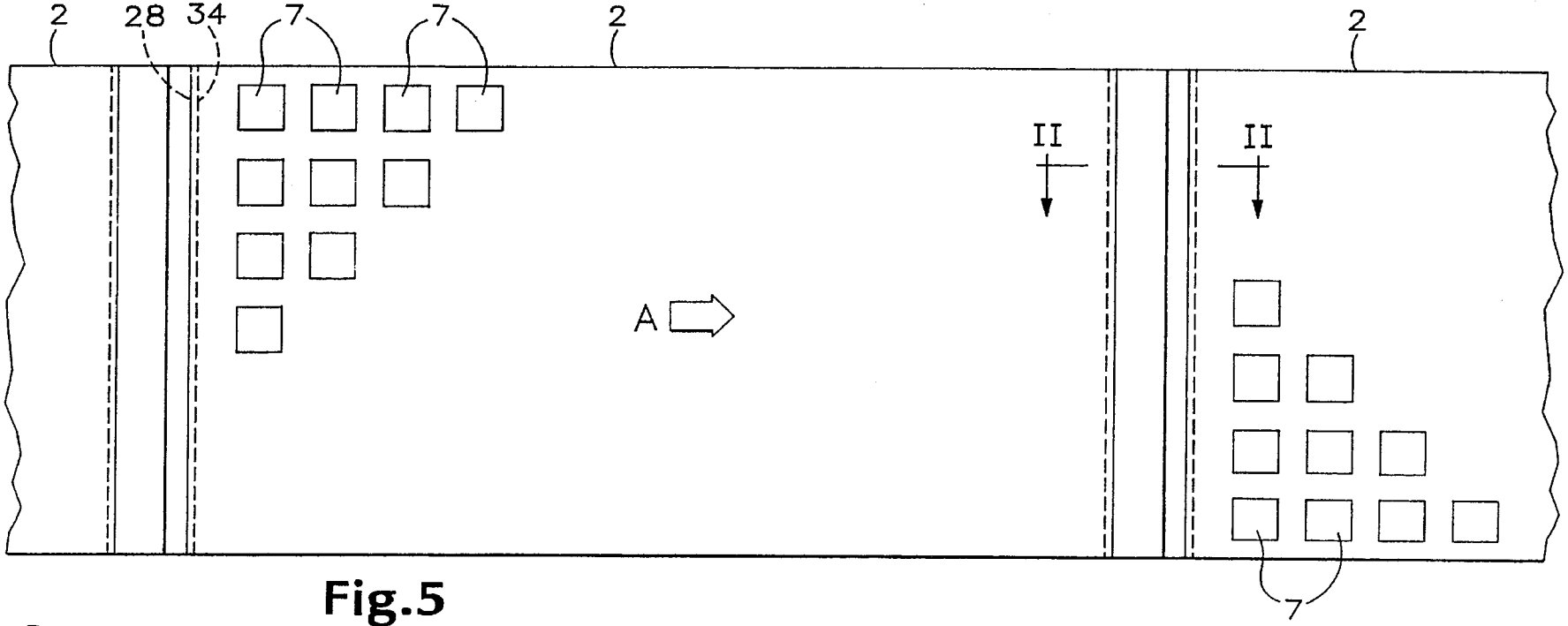
FIG. 5 shows a top view of a screen lining similar to that depicted in FIG. 1*a*.
Figure 6:
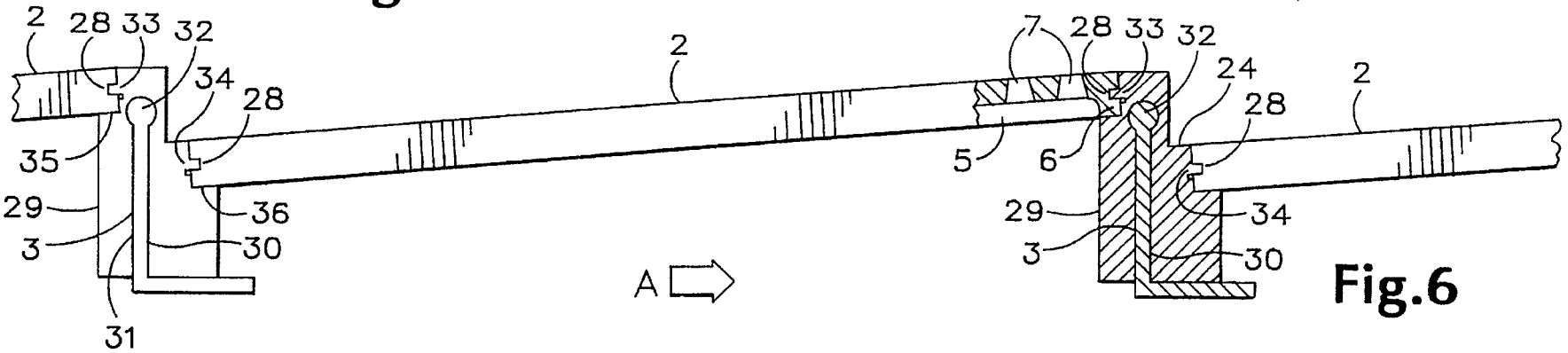
FIG. 6 shows a partial cutaway side view of a screen lining similar to that depicted in FIG. 5.
Figure 7:
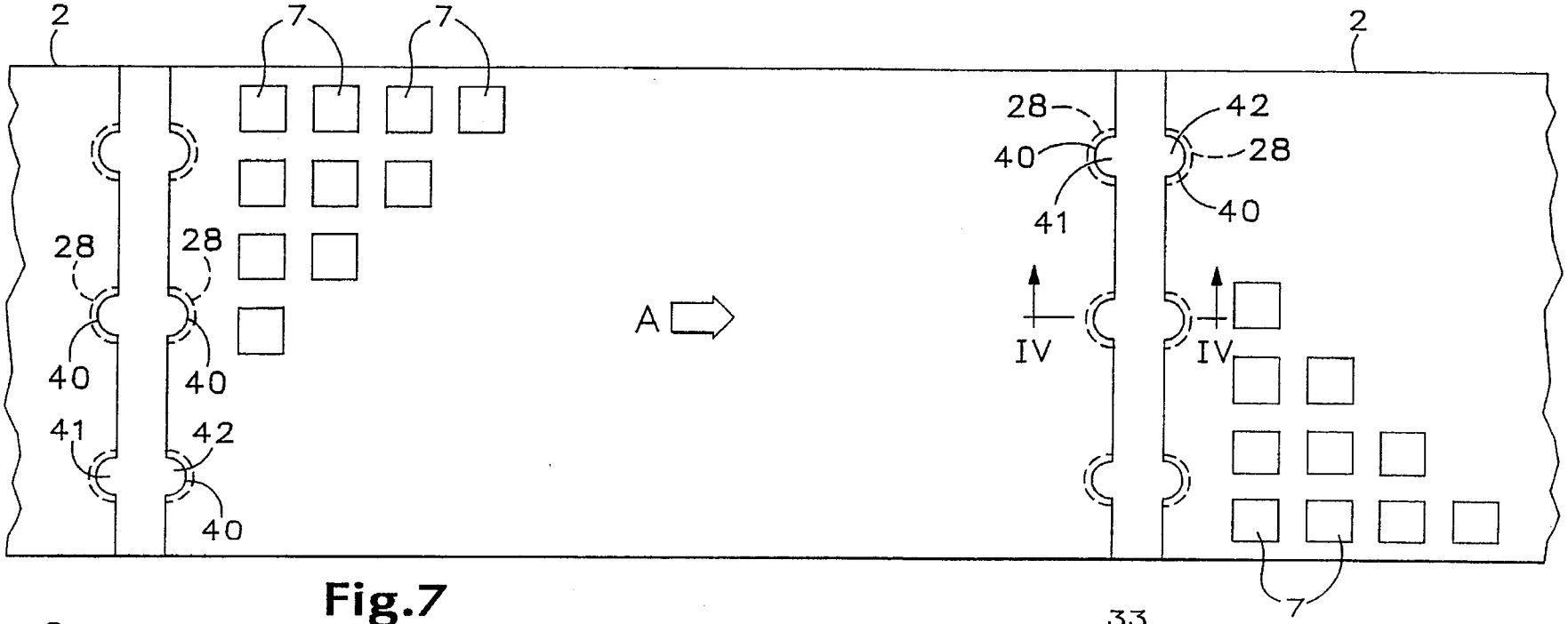
FIG. 7 shows a top view of a screen lining similar to that depicted in FIG. 1*a*.
Figure 8:
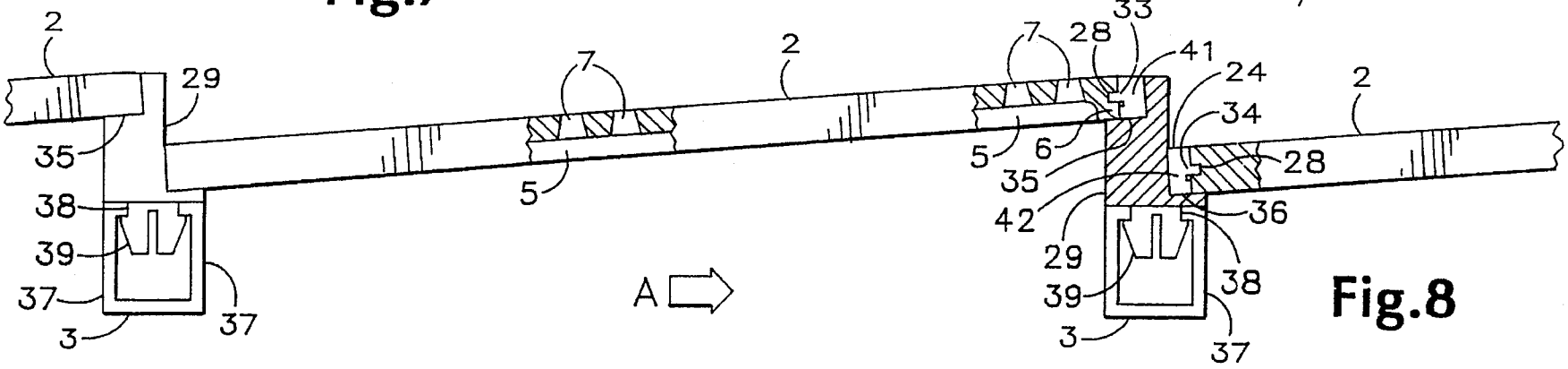
FIG. 8 shows a partially cut-away view of a screen lining according to FIG. 7.

FIGS. 5 to 8 show a detail of a screen lining on a vibrating screen machine with a series arrangement of screen elements 2 in the direction of conveyance A of the screened material. The screen lining may also have several successive screen elements. The screen frame of the screening machine has supporting sections 3 arranged at predetermined intervals across the direction of conveyance A of the screened material in which case they are usually welded onto an infrastructure. The screen elements 2 bridge the distance between the two supporting sections 3 and are arranged with a slope in the direction of conveyance as shown in FIGS. 6 and 8. A stair-step 24 is designed at the transition from one screen element 2 to the next screen element which follows in the direction of conveyance A.

Each screen element 2 is designed as a flat plate and may be made, for example, of castable polyurethane which is characterized by its especially high resistance to wear. Each screen element 2 has ribs 5 projecting downward on its longitudinal sides and has similar ribs 6 on its narrow sides which together form a type of frame. Within this outer frame, screen passages 7 are arranged. Each screen element has locking devices 28 that run at least on the ends across the direction of conveyance A and are designed as a transverse section in the embodiment illustrated in FIGS. 5 and 6.

Screen lining 1 also has strips 29 which are designed essentially as parallelepiped and have locking devices 30 on their underneath side or starting on their underneath side for locking onto the supporting sections 3. In the embodiment illustrated in FIGS. 5 and 6, the supporting sections 3 are designed as angle sections whose upright leg 31 has a rib 32 shaped on the free longitudinal edge. Accordingly, the locking device 30 on strip 29 which may also be made of castable polyurethane is designed as a groove or a slit with a cross section that corresponds to the upright leg of supporting section 3.

On the two longitudinal sides the strip 29 has locking devices 33, 34 which are designed in accordance with the locking device 28 on screen element 2, i.e., in the embodiment shown in FIG. 6 they are designed as longitudinal ribs. Locking devices 33 for the upper connection of the screen element and locking devices 34 for the lower connection are arranged at different heights, so each individual screen element 2 has a slope at a given angle due to the difference in height of locking devices 33 and 34 after locking them to strip 29, while the top side of strip 29 and the longitudinal side which is behind it in the direction of conveyance form step 24 in the upper area.

As FIG. 6 also shows, the locking devices 33 and 34 on strip 29 are offset in a stair-step manner toward the inside so that one step 35, 36 is formed beneath each of the locking devices 33, 34 and serves as a support for screen element 2.

The embodiment illustrated in FIGS. 7 and 8 differs from that in FIGS. 5 and 6 first of all in that the screening machine is equipped with different supporting sections 3. In this case they are designed as a U section whose legs 37 are indented along the free-longitudinal edge where they form a slit 38 running along the length of supporting section 3.

Strip 29, which is in turn designed essentially as a parallelepiped, has a profile 39 as the locking device on its lower side where the profile in the embodiment shown here consists of two wedge-shaped ribs arranged with a distance between them so they yield toward the inside when the strip 29 is driven onto the supporting section, and they pass slit 38 until they lock with the back cut in the supporting section 3. Instead of a continuous section 39, individual bolt-shaped locking devices, e.g., in the form of spreading pins with the cross section illustrated in FIG. 8, may also be provided.

Screen elements 2 again have locking devices 28 on their end faces which run across the direction of conveyance A of the screen material and are designed as hemispherical cups 40 arranged at predetermined intervals in this embodiment. The half-cups 40 have a partial ring groove at some distance from the top side.

Strip 29 again has locking devices 33, 34 arranged so they are offset in height along the longitudinal edges and are designed as semicircular projections 41, 42 with a partial ring-shaped elevation in this embodiment. The contour of the projections 41, 42 corresponds to the contour of the cup-shaped recesses 40 so that when the screen elements 2 are driven onto the strip 29, the partial ring-shaped projection on projections 41, 42 catches in the ring-shaped groove of the cup-shaped indentations 40. Here again the locking devices 33, 34 are offset in a stair-step manner toward the inside so that again a supporting surface 35, 36 for screen elements 2 is formed.

The aforementioned embodiments show that due to this strip with the arrangement of locking devices for the screen elements at different heights in combination with any desired supporting sections such as those conventionally found with existing screening machines, this creates the possibility of creating a stair-step screen lining with any desired shape of the supporting section.

Another preferred embodiment provides for the locking devices to be arranged so they are offset in a stair-step fashion toward the inside and the steps form a support for the screen elements on both longitudinal sides. In this way the load on the screen element is transferred directly into the strip, so the locking connection must absorb only the vibrational forces of the screening machine.

If the screening elements have a longitudinal profile on opposite sides as the locking devices in a manner, then the locking devices according to this invention are designed as a longitudinal locking profile on the longitudinal sides of the strip.

However, if the locking devices on the screen elements are designed as recesses, then the locking devices on the longitudinal sides of the strip are designed as projections arranged at predetermined intervals so they can engage with the recesses. With another known embodiment of screen elements, the locking devices are designed as cup-shaped indentations which supplement each other with corresponding cup-shaped indentations in the neighboring screen element to form a hole with a back cut into which a locking bolt can then be driven. In such a case, the locking devices are designed as cup-shaped indentations arranged at predetermined intervals on the longitudinal sides of the strip so they supplement each other to form a hole with a back cut together with the cup-shaped indentation on the other side of the screen element and then a separate locking bolt can be driven into the resulting hole.

With all these embodiments of the invention, it is advantageous if the strip has a width that corresponds at least to the width of the supporting profile, so the supporting section is completely covered by the strip and any screening material that may penetrate in the area of the locking devices will not come between the strip and the supporting section, so this protects the supporting section from wear.

Fundamentally, however, the strips may be made of any plastic but they are preferably made of the same plastic as the screen elements. Finally, the strips may also have a longitudinal reinforcement such as that also provided for the screen elements, if necessary from a technical standpoint.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A screening system for connection to a screening machine, comprising:

a frame for supporting a plurality of screening elements positioned thereon including means defining at least one mounting aperture;

a plurality of screening elements which form a screening surface, each screening element having a peripheral sidewall defining a plurality of attachment apertures and including means defining an array of sieve apertures of a predetermined size for allowing particulate material conveyed thereto, up to the predetermined size, to pass through each screening element; and a lock pin assembly for removably attaching said plurality of screening elements to said frame, said lock pin assembly comprising an elongate connector strip having first and second major opposite surfaces, a plurality of lock pins joined to said first major surface for attaching adjacent screen elements to the top side of the elongate connector strip, and means joined to the second major surface for connecting the lock pin assembly to said frame, said lock pins including means for interlockingly and removably engaging said attachment apertures to maintain the positioning of each screening element on the frame when the lock pin assembly is attached to the frame, said lock pin assembly remaining connected within at least one mounting aperture of the frame while allowing removal of a screening element from the frame and positioning of a replacement screening element on the frame, said connector strip having a wedge-shaped longitudinal cross-sectional configuration.

2. The screening system of claim 1, wherein the wedge shape of said elongate connector strip is at an angle corresponding to the angle of slope of the screen elements in the direction said particulate material is conveyed with an increasing slope in said direction.

3. The screening system of claim 1, wherein said screen elements are arranged in a stair-step configuration and the plurality of attachment apertures on the elongate connector strip are arranged at the same wedge angle for connecting the screen elements.

4. The screen system according to claim 1, wherein the elongate connector strip has a length that corresponds approximately to the extent of screen elements in the direction that the particulate material is conveyed.

5. The screen system according to claim 1, elongate connector strip is somewhat shorter than the length of screen elements in the direction the particulate material is conveyed, and the elongate connector strips are connected directly to each other in the direction that the particulate material is conveyed, while said screen elements overlap each other in a stair-step configuration.

6. The screen system according to claim 1, wherein the means for connecting the lock pin assembly to said frame extend over the entire length of the elongate connector strip.

7. The screen system according to claim 1, wherein the lock pins on said elongate connector strip are bolt-shaped and are arranged at intervals.

8. A screening system according to claim 1, wherein the lock pin assembly is formed of a polymeric material.

9. A screening system according to claim 1, wherein the means for attaching the lock pin assembly to the frame includes means defining a longitudinally-extending groove having interior walls such that the lower portion of the means for attaching the lock pin assembly to the frame can be reduced by moving the interior walls together.

10. A screening system according to claim 1, wherein said first major surface includes a pair of longitudinally-extending sides, and said lock pin assembly includes means on said first major surface for attaching adjacent screening elements thereon and for supporting said screening elements on said longitudinally-extending sides.

11. A screening system for connection to a screening machine, comprising:

a frame for supporting a plurality of screening elements positioned thereon including means defining at least one mounting aperture;

a plurality of screening elements, each screening element being spaced apart from the other with said frame located therebetween, and having a peripheral sidewall defining a plurality of attachment apertures and including means defining an array of sieve apertures of a predetermined size for allowing particulate material conveyed thereto, up to the predetermined size, to pass through each screening element; and a lock pin assembly for removably attaching said plurality of screening elements to said frame in a stair-step arrangement at different heights, said lock pin assembly comprising a connector strip having first and second means for attaching the screen elements to the connector strip and in turn to the frame, said first and second attachment means being located at different heights, and means for connecting the lock pin assembly to said frame, said lock pin assembly including means for interlockingly and removably engaging said attachment apertures to maintain the positioning of each screening element on the frame when the lock pin assembly is attached to the frame, said lock pin assembly remaining connected within at least one mounting aperture of the frame while allowing removal of a screening element from the frame and positioning of a replacement screening element on the frame.

12. The screening system of claim 11, wherein said first and second attachment means are arranged at different heights with respect to the frame thereby adjusting the difference in height and the desired angle of slope of the screen elements attached to said connector strip relative to said frame.

13. The screening system of claim 11, wherein the angle of slope of the screen elements is disposed in the direction said particulate material is conveyed with an increasing slope in said direction.

14. The screening system of claim 11, wherein said connector strip is in the form of a parallelepiped and the first and second means for attaching the screen elements to the connector strip are located on its opposed longitudinal sides and the means for connecting the lock pin assembly to said frame is located on its underneath side.

15. The screening system of claim 11, wherein said frame includes a continuous longitudinal slot on the top side and the connector strip means located on its underneath side which are removably attachable within, and detachable from, the continuous longitudinal slot.

16. The screening system of claim 11, wherein the frame includes recesses arranged at predetermined intervals on its top side, and the underneath side of the connector strip has locking bolts joined thereto which are arranged at complementary intervals with the recesses on the frame and so as to be engaged within the recesses during use.

17. The screening system of claim 11, wherein the frame includes a profiled rib on its top side, and the underneath side of the connector strip has a groove therein which is complementary with the profiled rib, so that the profiled rib is engaged within the groove during use.

18. The screening system of claim 11, wherein the first and second means for attaching the screen elements to the connector strip are offset and form steps on both longitudinal sides of said connector strip thereby creating a support for said screen elements.

19. The screening system of claim 11, wherein the first and second screen elements to the connector strip comprise longitudinal locking profiles with which are engageable with complementary longitudinal profiles on said screen elements.

20. The screening system of claim 11, wherein the first and second means for attaching the screen elements to the connector strip include projections arranged at predetermined intervals on the longitudinal sides of elongate connector strip, and the screen elements include recesses which are arranged at complementary intervals so that the projections on the frame will be engaged within the recesses during use.

21. The screening system of claim 11, wherein the first and second means for attaching the screen elements to the connector strip, and the plurality of apertures on said screening elements include cup-shaped indentations arranged at predetermined intervals comprising a hole into which separate locking members can be driven.

22. The screening system of claims 11, wherein the connector strip has a width that corresponds to at least to the width of the frame.

23. The screening system of claim 11, wherein the connector strip includes longitudinal reinforcement.

24. A lock pin assembly for readily, removably attaching said plurality of screening elements to said frame, which comprises an elongate strip having first and second major opposite surfaces, a plurality of lock pins joined to said first major surface for attaching adjacent screen elements to the top side of the elongate connector strip, and means joined to the second major surface for connecting the lock pin assembly to said frame, said lock pins including means for interlockingly and removably engaging said attachment apertures to maintain the positioning of each screening element on the frame when the lock pin assembly is attached to the frame, said lock pin assembly remaining connected within at least one mounting aperture of the frame while allowing removal of a screening element from the frame and positioning of a replacement screening element on the frame, said connector strip having a wedge-shaped cross-sectional configuration.

25. A lock pin assembly for readily, removably attaching said plurality of screening elements to said frame, which comprises a lock pin assembly for removably attaching said plurality of screening elements to said frame in a stair-step arrangement at different heights, each screening element being spaced apart from the other with said frame located therebetween, said lock pin assembly comprising a connector strip having first and second means for attaching the screen elements to the connector strip and in turn to the frame, said first and second attachment means being located at different heights, and means for connecting the lock pin assembly to said frame, said lock pin assembly including means for interlockingly and removably engaging said attachment apertures to maintain the positioning of each screening element on the frame when the lock pin assembly is attached to the frame, said lock pin assembly remaining connected within at least one mounting aperture of the frame while allowing removal of a screening element from the frame and positioning of a replacement screening element on the frame.

* * * * *